US010450113B2

(12) United States Patent
Kieras et al.

(10) Patent No.: US 10,450,113 B2
(45) Date of Patent: Oct. 22, 2019

(54) RELATING TO CLOSURES

(71) Applicant: Obrist Closures Switzerland GmbH, Reinach (CH)

(72) Inventors: Ron Kieras, Woodstock, IL (US); Rene Lawell, Ingleside, IL (US); Remchile Sienes, Lake Villa, IL (US)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/505,045

(22) PCT Filed: Aug. 14, 2015

(86) PCT No.: PCT/EP2015/068801
§ 371 (c)(1),
(2) Date: Feb. 17, 2017

(87) PCT Pub. No.: WO2016/026794
PCT Pub. Date: Feb. 25, 2016

(65) Prior Publication Data

US 2017/0267422 A1 Sep. 21, 2017

(30) Foreign Application Priority Data

Aug. 18, 2014 (GB) ..... 1414603.9

(51) Int. Cl.
*B65D 47/08* (2006.01)
*B65D 47/20* (2006.01)
*B65D 43/02* (2006.01)

(52) U.S. Cl.
CPC ..... *B65D 47/0804* (2013.01); *B65D 43/02* (2013.01); *B65D 47/2031* (2013.01); *B65D 2251/20* (2013.01)

(58) Field of Classification Search
CPC ..... B65D 47/0804; B65D 47/2031; B65D 43/02; B65D 2251/20
See application file for complete search history.

(56) References Cited

U.S. PATENT DOCUMENTS

2005/0279781 A1 12/2005 Pugne
2006/0043052 A1* 3/2006 Lin ..... B65D 47/0838 215/253
2006/0138163 A1 6/2006 Danks
2006/0169723 A1 8/2006 Friedman
2010/0102021 A1* 4/2010 Guglielmini ..... B65D 47/0833 215/228
2012/0067922 A1* 3/2012 Benoit-Gonin .... B65D 47/0857 222/153.06
2012/0080450 A1 4/2012 Dziersk et al.
(Continued)

OTHER PUBLICATIONS

Nov. 5, 2015—(WO) International Search Report and Written Opinion—App PCT/EP2015/068801.

*Primary Examiner* — Donnell A Long
(74) *Attorney, Agent, or Firm* — Banner & Witcoff, Ltd.

(57) ABSTRACT

A dispensing closure includes a base and a lid. The base includes a dispensing spout defining a dispensing orifice. A self-closing valve controls fluid flow out of the orifice in use. The lid includes a spout sealing arrangement including an external seal for sealing against an outer face of the spout and an internal seal for sealing against an inner face of the spout.

12 Claims, 4 Drawing Sheets

Double Plug Seal

(56) References Cited

U.S. PATENT DOCUMENTS

| | | | | |
|---|---|---|---|---|
| 2012/0279966 | A1* | 11/2012 | Mazurkiewicz | B65D 47/0804 220/257.1 |
| 2013/0026168 | A1* | 1/2013 | Mazurkiewicz | B65D 47/0814 220/254.1 |
| 2013/0037510 | A1* | 2/2013 | Tamarit Rios | B65D 47/0804 215/259 |
| 2013/0119062 | A1* | 5/2013 | Ziegenhorn | B65D 43/22 220/266 |
| 2013/0119079 | A1* | 5/2013 | Ziegenhorn | B65D 47/0804 220/810 |
| 2013/0240564 | A1* | 9/2013 | Albaum | B65D 47/2031 222/129 |
| 2015/0001260 | A1* | 1/2015 | Hoshino | B65D 47/40 222/481 |
| 2016/0167864 | A1* | 6/2016 | De Cleir | B65D 1/04 206/221 |
| 2016/0244219 | A1* | 8/2016 | Benoit-Gonin | B65D 47/0804 |

* cited by examiner

Double Plug Seal

1. Internal Sealing with Valve Retention
2. External Sealing with Audible Click

Specifically shaped Cruciform contoured to the valve to prevent valve flaps from opening when lid is closed Extreme lead in to orifice to ensure proper engagement with Orifice

RELATING TO CLOSURES

CROSS-REFERENCE TO RELATED APPLICATIONS

The present application is a U.S. National Phase of International Application No. PCT/EP2015/068801, filed on Aug. 14, 2015, designating the United States of America, and claims priority to British Patent Application No. 1414603.9, filed Aug. 18, 2014. This application claims priority to and the benefit of the above-identified applications, each of which is fully incorporated by reference herein.

The present invention relates generally to closures and particularly, although not exclusively, to a seal system for a closure.

According to the present invention there is provided a dispensing closure comprising a base and a lid, the base comprising a dispensing spout defining a dispensing orifice and a self-closing valve is provided to control fluid flow out of the orifice in use, the lid comprising a spout sealing arrangement including an external seal for sealing against an outer face of the spout and an internal seal for sealing against an inner face of the spout.

The self-closing valve may be formed from, for example silicon, a thermoplastic vulcanisate (TPV) material, a thermoplastic elastomer (TPE) material or a rubber material, such as nitryl rubber. Combinations of different materials are possible. Bi-injected valves are possible.

Flexible self-closing valves come in many forms and the construction may be generalised as comprising: a concave or convex shaped head portion with at least one slit; a side wall portion; and a flange.

The spout may be formed as a hollow tubular member which may, for example, upstand around an orifice provided in the top deck of a base.

The internal seal may include a portion which engages an exterior face of the valve to retain the valve in a closed position. The portion may be contoured to match the contour of the valve exterior face.

The valve may comprise one or more slits defining flaps and the portion may be configured to prevent the flaps from opening when the lid is closed.

The portion may have a generally cruciform shape. For example in one embodiment the portion has three limbs. The cruciform may be of a specific shape and dimension to prevent premature opening of the valve when the package is subjected to squeezing, shaking, or dropping.

The external seal and the spout outer face may include cooperating retention beads which engage with the lid is closed on the base. In some embodiments the beads provide an audible "click" when they engage.

The internal seal may comprise a spud which may, for example extend concentrically to the outer seal. The spud may depend from the underside of the lid. There may be a specific interference between a spud and an orifice that provides an excellent seal for many product ranges.

The outer seal may be generally annular, for example a cylindrical skirt which depends from the underside of the lid.

In some aspects and embodiments the present invention relates to a double orifice plug seal.

In some aspects and embodiments the present invention relates to a double seal closure system.

A large lid ring may provide a secondary seal and latching system to ensure the primary seal is maintained.

A snap feature may be separated from the primary seal feature which ensures better moulding and seal integrity.

The opening force of the cap may be maintained at a value that is convenient for the end user.

A lead-in on the deck (for example formed on a base) may be of sufficient size to ensure alignment of the spud into the orifice without damage to the seal surfaces.

The spout may include an angled lead-in, such as an inclined mouth. In some embodiment this can be used to ensure smooth engagement of the sealing system.

The valve may be carried by a valve retention body. For example the valve may form part of a valve sub-assembly in which the valve is carried by a retention body and the retention body fits into the base (for example it may be retained in the spout).

The present invention also provides a flip-top dispensing closure comprising a base and a lid connected by a hinge so that the lid is movable between a closed position and an open position with respect to the base, the base comprising a generally annular dispensing spout defining a dispensing orifice and a self-closing valve is provided in the spout to control fluid flow out of the orifice in use, the lid comprising a spout sealing arrangement including a generally cylindrical external seal for sealing against an outer face of the spout and an internal spud seal for sealing against an inner face of the spout.

The closure may comprise a base and a lid, which may be joined together by a hinge.

In some embodiments the closure is a flip-top dispensing closure.

The present invention also provides a closure as described herein in combination with a container The present invention also provides a package (such as a container, bottle, capsule or pod) comprising or including a closure as described herein. The package may be filled with a product, for example a beverage, condiment, cosmetic or other consumable.

Different aspects and embodiments of the invention may be used separately or together.

The present invention is more particularly shown and described, by way of example, with reference to the accompanying drawings, in which.

Figure 1:
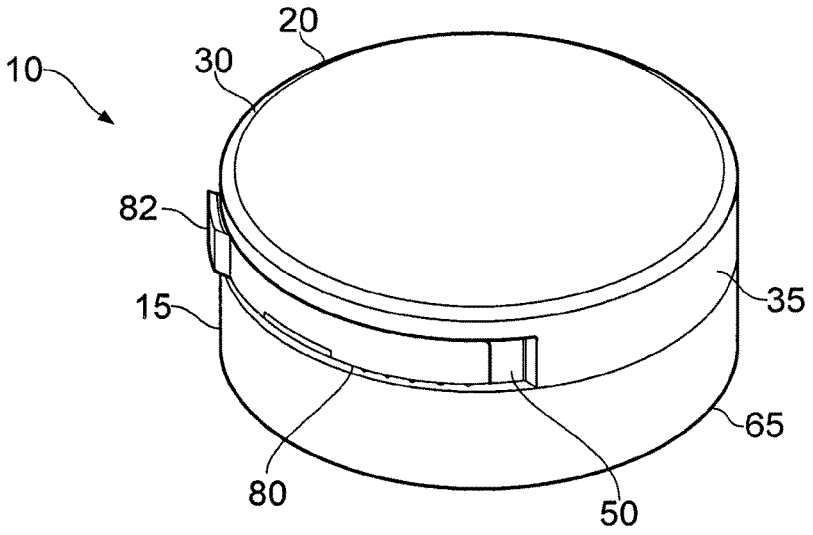
FIG. 1 is a perspective view of a closure of the type formed in accordance with the present invention and shown in a closed position.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Figure 2:
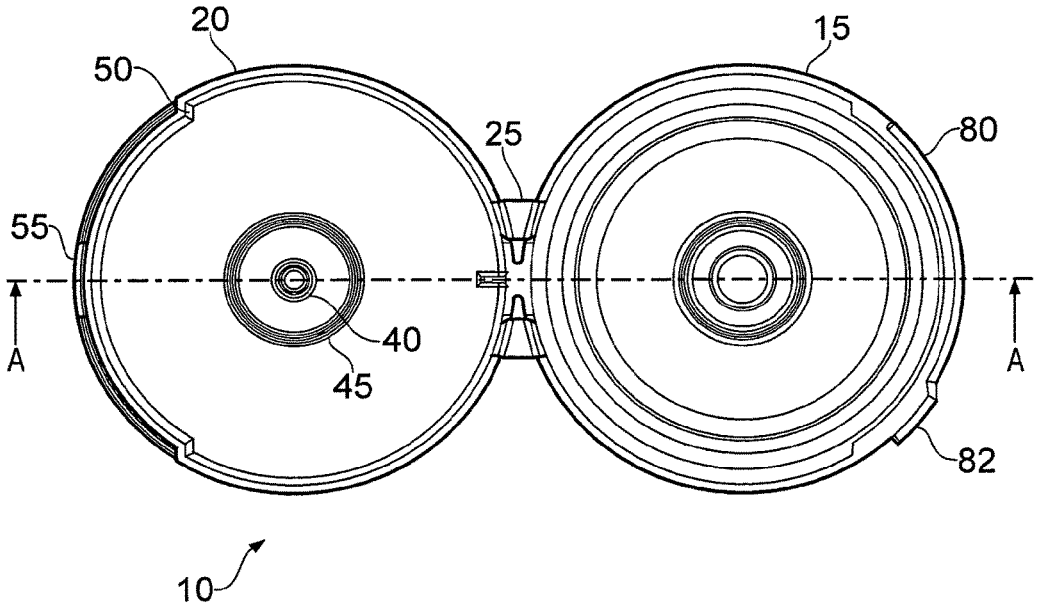
FIG. 2 is a plan view of the closure of FIG. 1 shown in an open position.
Figure 3:
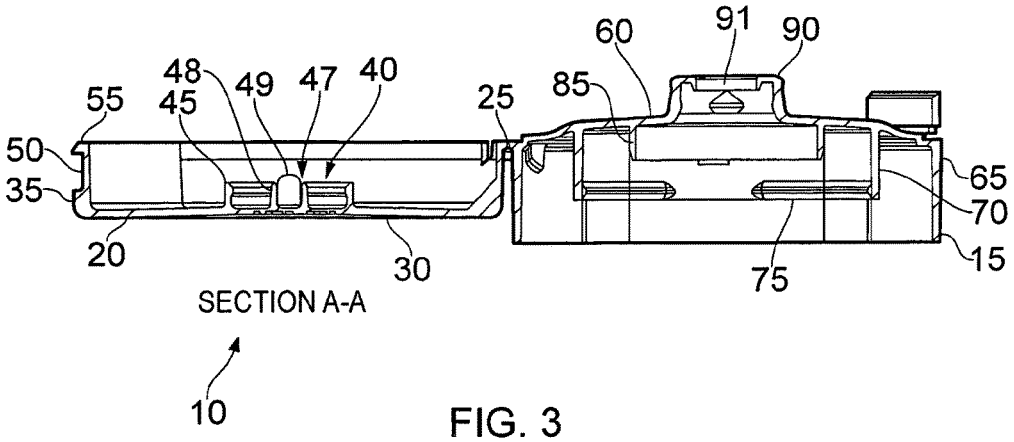
FIG. 3 is a section of the closure of FIG. 2 taken along line A-A.

Referring first to FIGS. 1 to 3 there is shown a closure generally indicated 10. The closure 10 comprises a generally cylindrical body with a base 15 and a lid 20. The base 15 and lid 20 are connected to each other by a hinge 25.

The lid 20 comprises a circular, disc-shape top plate 30 and a generally cylindrical side wall 35 which depends from the periphery of the plate 30.

A double plug seal arrangement 40 depends from the centre of the underside of the lid top plate 30.

The seal arrangement 40 comprises a generally cylindrical outer seal 45 and an inner spud 47 which includes an outer wall 48 and an inner plug 49.

Opposite the hinge the lid side wall 35 includes an arcuate recess 50 an at the centre of the recess 50 a hook 55 projects from the open end of the skirt 35.

The base 15 comprises a generally circular-disc shape top deck 60 which is gently convexly curved. A generally cylindrical outer skirt 65 depends from the periphery of the deck 60. A further, cylindrical inner skirt 70 depends from the deck 60 radially inwardly of the outer skirt 65. At the open end of the skirt 70 a discontinuous annular snap bead 75 is positioned.

A sealing spigot 85 depends from the deck radially inwardly of the skirt 70.

At the centre of the deck 60 an annular spout 90 projects and defines a central dispensing orifice 91. Within the spout 90 a self-closing valve 92 is carried (see FIG. 4).

Opposite the hinge 25 an arcuate tamper-evident band 80 upstands from the deck 60 and is connected thereto by a plurality of frangible bridges 81. At one end of the band 80 is a pull tab 82 which is not directly connected to the platform 60. At the centre of the band a notch 83 is provided.

The closure 10 is representative of the general type of closure suitable for use with the present invention, as described in more detail below.

Figure 4:
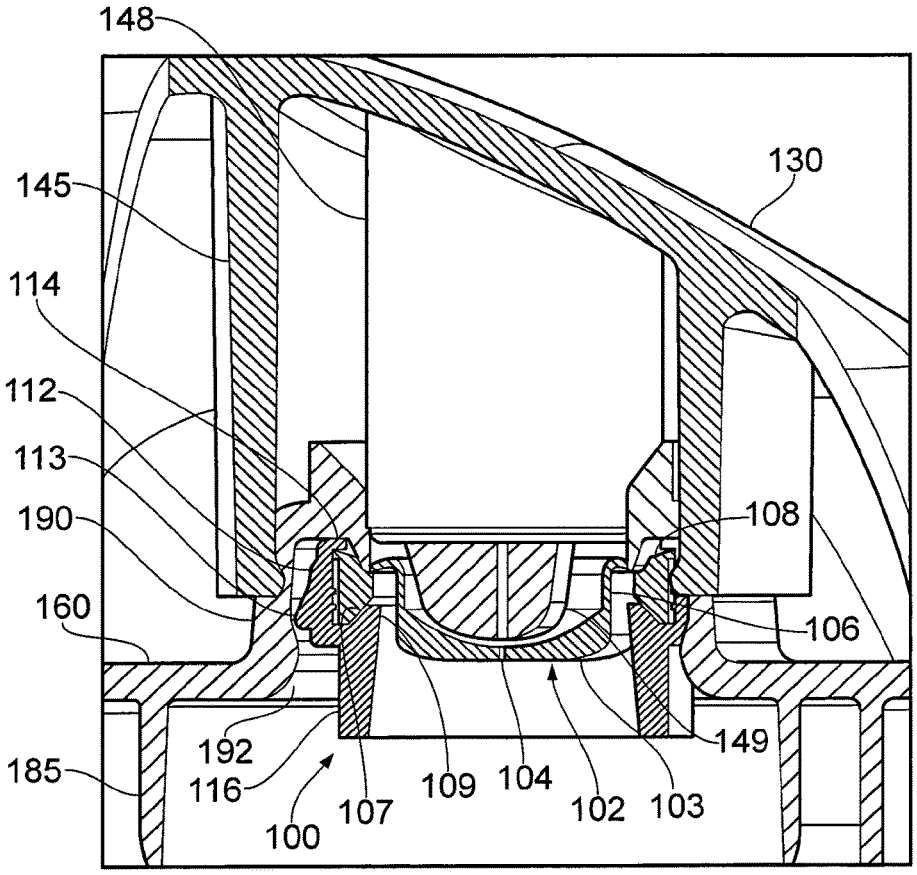
FIG. 4 is a magnified section of a closure formed according to the present invention shown in the region of a dispensing orifice.
Figure 5:
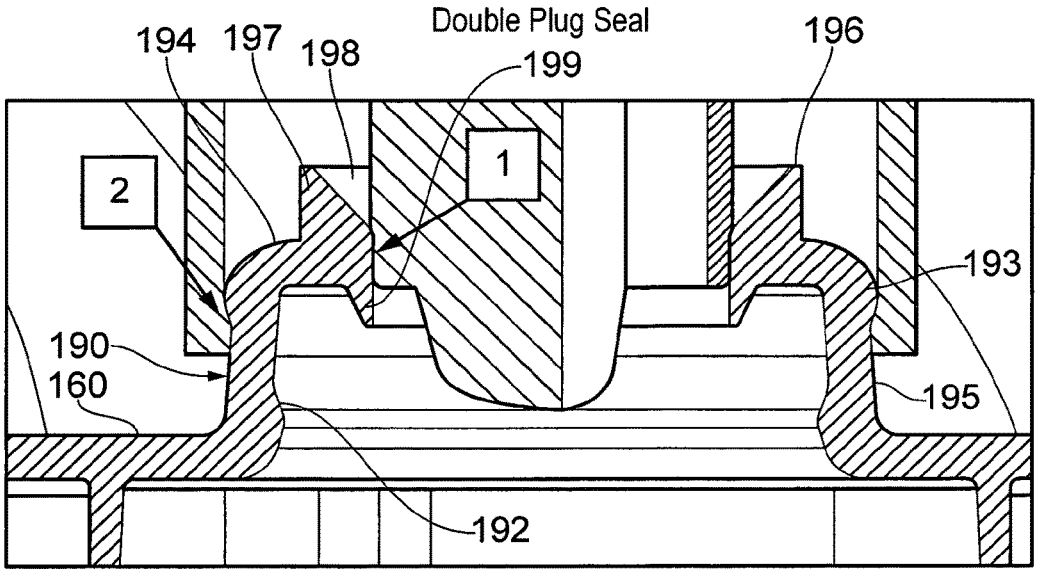
FIG. 5 shows the region of FIG. 4 with a self-closing valve removed.
Figure 6:
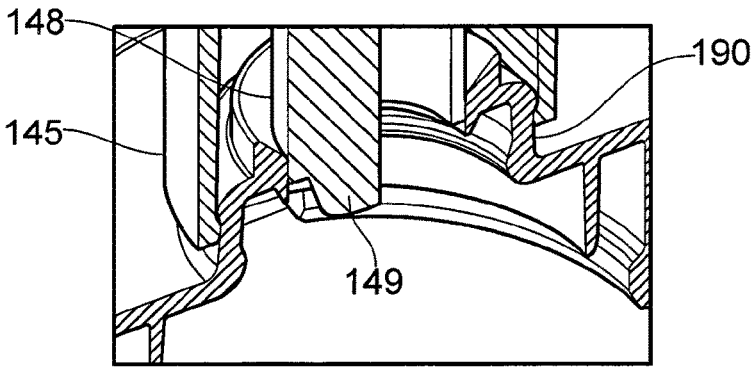
FIG. 6 is a further view of the region of FIG. 5.
Figure 7:
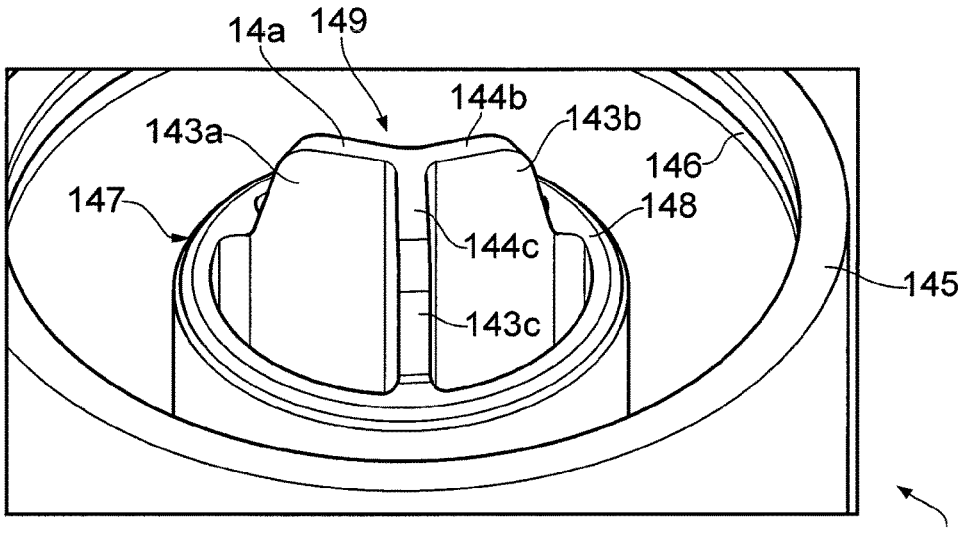
FIG. 7 is a magnified view of a sealing arrangement of FIGS. 4 to 6.
Figure 8:
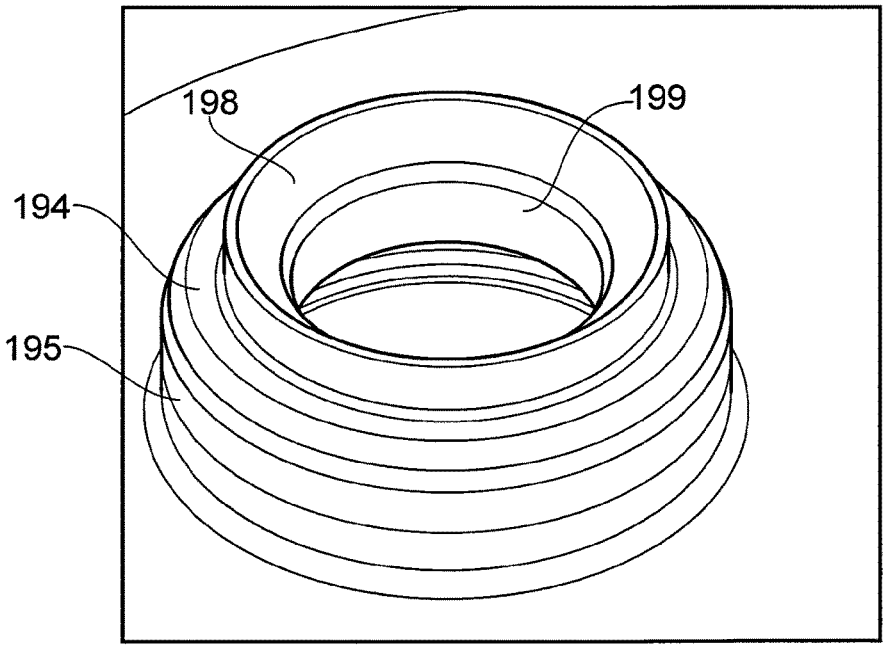
FIG. 8 is a magnified view of the dispensing spout of the FIGS. 4 to 6.

Referring now to FIG. 4 there is shown a magnified view of the region of a closure dispensing spout 190.

Within the spout 190 is fitted a self-closing valve sub-assembly 100, comprising a valve 102 and a retaining member 101 which shall be referred to hereinafter as a retaining ring 101.

The ring 101 consists of a moulded single-piece article/body with a so-called "chimney" in the form of a circular wall 116. This chimney 116 provides a surface for assembly machinery to handle the retaining ring 101. At the outer radial end of the chimney wall 116 another circular wall 112, which has the same rotational axis as chimney 116, extending upwards. This end of the wall also includes an inner ring 109 that forms a seat 107.

Along the circumference of the radially outer surface of wall 112 is a projection in the form of an external snap bead 113. At the end of wall 112 is a crimping flange 114 which in its uncrimped condition is an upstanding wall.

The flexible self-closing valve 102 has a head portion 103, which is thicker towards the edge than the centre and which has at least one slit 104 therein. The head portion 103 is concave with respect to a container (not shown). This pre-stresses the valve so that it self-closes more easily.

A side-wall or connecting wall portion 106 connects the head portion 103 with a flange 108. Flange 108 is typically shaped such that it has a relatively substantial size in the form of a rim. It is this flange 108 which rests on the inner ring 109 and sits in the seat 107 of the retaining ring 101 when it is located correctly. This forms a self-closing valve sub-assembly 100 that can easily be manipulated.

In this embodiment, to crimp the valve 102 in place, the crimping flange 114 is bent over until it sandwiches the flange 108 between itself 114 and the sloping surface 111.

Although in this embodiment the crimping flange 108 is shown as being bent over by 90 degrees radially inwards it should be understood that the angle through which it need be bent is not fixed.

The sub-assembly 100 is formed separately from the closure and also from the container.

The end of the spout wall which merges into the base deck 160 is provided with an annular snap bead 192. The bead 192 cooperates with the body bead 113 to allow the sub-assembly 100 to be fitted into the spout 190.

FIGS. 5 to 8 show the spout/sealing arrangement in more detail.

The sealing arrangement 140 comprises a generally cylindrical outer wall 145 formed with a bead 146 at its free end. An inner sealing spud 147 is provided and includes an outer sealing wall 148 and an inner sealing plug 149.

The inner sealing plug 149 is a generally cruciform- or Y-shape with, in this embodiment, three legs 143*a*, 143*b*, 143*c*. Each of the legs includes a curved terminal face 144*a*, 144*b*, 144*c*.

The spout 190 comprises a generally cylindrical main wall 195. One end of the wall 195 merges into the base top deck 160; at this end an annular internal snap bead 192 is provided. The other end of the wall 195 is provided with an external annular snap bead 193. The wall 195 continues with a radially inwardly directed shoulder 194 at the centre of which a terminal orifice portion 196 is provided. The portion 196 comprises a triangular section annular upstand 197 with an inclined inner face 198. An annular wall 199 depends from the free end of the wall 195.

In use, when the lid is closed onto the base, the outer wall 145 seals against the spout wall 195 and the beads 146, 193 engage. The sealing arrangement wall 148 seals against the interior of the upstand 197. The faces 144*a*, 144*b*, 144*c* press against the valve head 103 and prevent the petals from opening so that leakage of product out of the valve is prevented when the lid is closed.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A dispensing closure comprising a base and a lid, said base comprising a top deck, a dispensing spout on said top deck, defining a dispensing orifice through said top deck and a self-closing valve provided in the orifice to control fluid flow out of the orifice in use, the lid comprising a spout sealing arrangement including an external seal for sealing against an outer face of the spout and an internal seal for sealing against an inner face of the spout, in which the internal seal comprises a spud including an inner plug, the spout comprises a generally cylindrical main wall, one end of said main wall merges into the base top deck, at said one end an annular internal snap bead is provided, another end of said main wall is provided with an external annular snap bead, said main wall continues with a radially inwardly directed shoulder at the center of which a terminal orifice portion is provided, said terminal orifice portion comprises a triangular section annular upstand with an inclined inner face, and an annular wall depends from the free end of said main wall.

2. A closure as claimed in claim 1, in which the internal seal includes a portion which engages an exterior face of the valve to retain the valve in a closed position.

3. A closure as claimed in claim 2, in which the portion is contoured to match a contour of the valve exterior face.

4. A closure as claimed in claim 2, in which the valve comprises one or more slits defining flaps and in which the portion prevents the flaps from opening when the lid is closed.

5. A closure as claimed in claim 2, in which the portion has a generally cruciform shape.

6. A closure as claimed in claim 5, in which the portion has three limbs.

7. A closure as claimed in claim 1, in which the external seal is generally annular.

8. A closure as claimed in claim 1, in which the valve is carried by a valve retention body.

9. A closure as claimed in claim 8, in which the body is retained in the spout.

10. A closure as claimed in claim 1 in combination with a container.

11. A closure as claimed in claim 1, in which the external seal and the spout outer face include cooperating retention beads which engage when the lid is closed on the base.

12. A closure as claimed in claim 1, in which the internal seal seals against the interior of said triangular section annular upstand.

* * * * *